US012352530B2

(12) United States Patent
Grazioplene et al.

(10) Patent No.: US 12,352,530 B2
(45) Date of Patent: Jul. 8, 2025

(54) MUZZLE LOADING SYSTEM

(71) Applicants: Michael J. Grazioplene, Oakfield, NY (US); Jeffrey P. Grazioplene, Batavia, NY (US)

(72) Inventors: Michael J. Grazioplene, Oakfield, NY (US); Jeffrey P. Grazioplene, Batavia, NY (US)

( * ) Notice: Subject to any disclaimer, the term of this patent is extended or adjusted under 35 U.S.C. 154(b) by 0 days.

(21) Appl. No.: 18/534,927

(22) Filed: Dec. 11, 2023

(65) Prior Publication Data

US 2024/0318937 A1 Sep. 26, 2024

Related U.S. Application Data

(60) Provisional application No. 63/436,958, filed on Jan. 4, 2023.

(51) Int. Cl.
*F41C 9/08* (2006.01)

(52) U.S. Cl.
CPC ..... *F41C 9/085* (2013.01)

(58) Field of Classification Search
CPC ..... F41C 9/08; F41C 9/085
See application file for complete search history.

(56) References Cited

U.S. PATENT DOCUMENTS

| | | | | |
|---|---|---|---|---|
| 42,741 A | | 5/1864 | Bradford | |
| 3,263,664 A | | 8/1966 | Bauer et al. | |
| 3,558,007 A | | 1/1971 | Seghezzi et al. | |
| 3,747,252 A | * | 7/1973 | Walker | F41C 9/085 42/106 |
| 3,854,625 A | | 12/1974 | Kuebler | |
| 3,956,844 A | | 5/1976 | Misevich et al. | |
| 4,050,175 A | * | 9/1977 | Mulinix | F41C 9/085 42/90 |
| 4,112,606 A | | 9/1978 | Griffin | |
| 4,152,858 A | * | 5/1979 | Dobbs | F41C 9/085 86/33 |
| 4,174,048 A | | 11/1979 | Volpe, Jr. | |
| 4,229,897 A | | 10/1980 | Snowden | |
| 4,373,285 A | * | 2/1983 | Grout | F41C 9/085 42/90 |

(Continued)

OTHER PUBLICATIONS

Thompson Center MuzzCharger. <https://web.archive.org/web/20220123070942/https://www.amazon.com/Thompson-Center-MuzzCharger-Single-Stroke-Shooting/dp/B07794R7GW>. Jan. 23, 2022. (Year: 2022).*

(Continued)

*Primary Examiner* — Gabriel J. Klein
(74) *Attorney, Agent, or Firm* — Dawson Law Firm, P.C.; Michael J. Nickerson

(57) ABSTRACT

A muzzleloader includes a shot holding member having a first end configured to receive an object to be loaded into the muzzle and a second end; the shot holding member including a hollow shot holding chamber; and an actuator located at the first end of the shot holding member. The actuator includes a plunger having a head portion, a connector configured to connect the actuator to the first end of the shot holding member, a first O-ring configured to encircle the connector and located between the connector and the first end of the shot holding member, and a second O-ring configured to encircle the plunger and located between a head portion of the plunger and the connector.

17 Claims, 8 Drawing Sheets

(56) References Cited

U.S. PATENT DOCUMENTS

| | | | | | |
|---|---|---|---|---|---|
| 4,442,620 | A | | 4/1984 | Drake et al. | |
| 4,466,209 | A | | 8/1984 | Strickland et al. | |
| 4,536,983 | A | * | 8/1985 | Fry | F41C 9/085 42/90 |
| 4,783,925 | A | * | 11/1988 | Pollock, Jr. | F41C 9/085 42/95 |
| 4,817,322 | A | | 4/1989 | Dietz et al. | |
| 4,862,623 | A | | 9/1989 | Delap et al. | |
| 4,875,303 | A | * | 10/1989 | DeWeert | F41C 9/085 42/90 |
| 4,974,357 | A | * | 12/1990 | Jones | F41C 9/085 42/90 |
| 5,097,615 | A | * | 3/1992 | Kearns | F41C 9/085 42/90 |
| 5,109,623 | A | | 5/1992 | French | |
| 5,182,412 | A | * | 1/1993 | Mazza | F41C 9/085 42/90 |
| 5,435,089 | A | | 7/1995 | Rodney | |
| 5,446,987 | A | | 9/1995 | Lee et al. | |
| 5,978,799 | A | | 11/1999 | Dedeaux et al. | |
| 6,637,143 | B1 | | 10/2003 | Wykle | |
| 7,165,351 | B2 | | 1/2007 | Church | |
| 7,204,391 | B2 | | 4/2007 | Toker | |
| 7,451,563 | B1 | | 11/2008 | McKnight | |
| 7,877,919 | B2 | | 2/2011 | Richards | |
| 7,954,480 | B2 | | 6/2011 | Broberg | |
| 8,112,932 | B1 | | 2/2012 | Vollmer | |
| 8,291,894 | B2 | | 10/2012 | Barwick | |
| 8,308,026 | B2 | | 11/2012 | Rapko | |
| 9,021,735 | B2 | | 5/2015 | Ervin | |
| 2004/0244260 | A1 | | 12/2004 | Kanyuck et al. | |
| 2006/0162218 | A1 | | 7/2006 | Church | |
| 2007/0170202 | A1 | * | 7/2007 | Chen | A61J 7/0076 221/244 |
| 2008/0263927 | A1 | | 10/2008 | Orlob | |
| 2011/0302818 | A1 | | 12/2011 | Samaras et al. | |
| 2013/0091752 | A1 | | 4/2013 | Ervin | |
| 2014/0090284 | A1 | | 4/2014 | Peterson et al. | |
| 2015/0047245 | A1 | | 2/2015 | Erivn | |
| 2016/0146570 | A1 | * | 5/2016 | Grazioplene | F41C 9/085 42/51 |

OTHER PUBLICATIONS

RMC Magnum EC-Loader, "http://www.rmcoxyoke.com/inc/sdetail/rmc_magnum_ec_loader/6558/201" Nov. 24, 2014.
RMC Magnum EC Speed Shells, "http://www.rmcoxyoke.com/inc/sdetail/magnum_ec_view_speed_shells/6552/202" Nov. 24, 2014.
RMC Flintlock Hunter Starter Kit, "http://www.rmcoxyoke.com/inc/sdetail/rmc_flintlock_hunter_starter_kit/6549/85" Nov. 24, 2014.

* cited by examiner

MUZZLE LOADING SYSTEM

PRIORITY INFORMATION

This application claims priority, under 35 U.S.C. § 119(e), from U.S. Provisional Patent Application, Ser. No. 63/436,958, filed on Jan. 4, 2023. The entire content of U.S. Provisional Patent Application, Ser. No. 63/436,958, filed on Jan. 4, 2023, is hereby incorporated by reference.

BACKGROUND

A muzzleloader is a firearm, wherein a projectile (bullet and/or slug) and usually a propellant charge is loaded into the firearm through the muzzle of the firearm.

A conventional muzzleloader loading device utilizes a muzzle loader device having therein formed premeasured powder pellets (propellant charge).

An example of a conventional muzzleloader loading device is described in Published US Patent Application Number 2006/0162218-A1. The entire content of Published US Patent Application Number 2006/0162218-A1 is hereby incorporated by reference.

Published US Patent Application Number 2006/0162218-A1 describes a muzzleloader loading device for a muzzle loading firearm comprised of a hollow tubular body with a ball starter rod stowed, requiring the user to remove the ball starter rod and configure for loading a firearm.

Since the projectile and propellant charge for a muzzleloader is loaded through the muzzle of the firearm, as opposed to being chambered by non-muzzle loading firearms, hunters face the challenge of performing a quick reload to ensure a second shot in a short period of time before the target of the shot disappears or moves out of range, resulting in a missed opportunity, or before the target of the shot converges upon the hunter, resulting in possible injuries.

In other words, time can be of the essence when faced with a first shot mishap and a window of opportunity remains open, as a hunter attempts to reload for a second shot.

Other problems associated with the use of a muzzle loading firearm are wet non-pelletized powder (propellant charge), fouled mechanisms, accidentally loading spent primers, and dropping (leaking) non-pelletized powder (propellant charge) and/or the bullet, etc.

Therefore, it is desirable to provide a muzzle loading device/system that reduces the risk of missed opportunities.

Moreover, it would be desirable to provide a muzzle loading device/system that eliminates or substantially mediates the issues associated with wet non-pelletized powder (propellant charge), fouled mechanisms, and/or accidentally loading spent primers.

It is also desirable to provide a muzzle loading device/system that enables efficient loading of powder and/or bullet, thereby maximizing the speed of loading and minimizing the number of steps.

Further, it would be desirable to provide a muzzle loading device/system that eliminates the risk of a "failed" load (dropping (leaking) non-pelletized powder (propellant charge) and/or the bullet).

Lastly, it would be desirable to provide a muzzle loading device/system that eliminates the risk of a "failed" load (dropping (leaking) non-pelletized powder (propellant charge) and/or the bullet) and also reduces the time to perform the muzzle loading operation.

BRIEF DESCRIPTION OF THE DRAWINGS

The drawings are only for purposes of illustrating various embodiments and are not to be construed as limiting, wherein.

DETAILED DESCRIPTION

Figure 1:
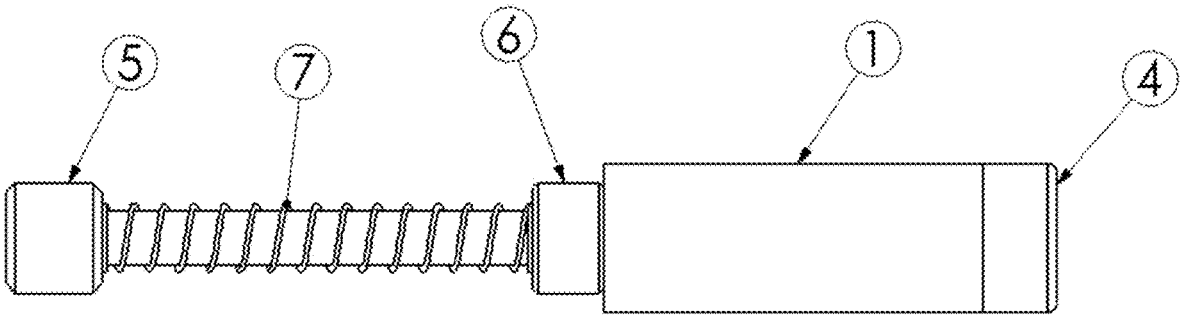
FIGURE 1 (Prior Art)
FIG. 1 is an illustration of a conventional muzzle loading device.

For a general understanding, reference is made to the drawings. In the drawings, like references have been used throughout to designate identical or equivalent elements. It is also noted that the drawings may not have been drawn to scale and that certain regions may have been purposely drawn disproportionately so that the features and concepts could be properly illustrated.

In the description below, the term shot is used to define the object being loaded into a muzzleloader firearm, wherein the object is a combination of pelletized propellant and projectile, and the pelletized propellant may be various quantities of formed premeasured powder pellets.

As noted above, FIG. 1 illustrates a conventional muzzle loading device. As illustrated in FIG. 1, the conventional muzzle loading device includes a shot holding body/chamber 1, which holds the pelletized propellant and projectile prior to loading into a muzzle of a firearm, and an actuator or loading mechanism (plunger 5, spring 7, and nut 6) for providing the actuation or force needed to load the shot into an end of a muzzle of a muzzleloader firearm.

The conventional muzzle loading device may include an end cap 4, which slides over the end of the shot holding body/chamber 1, to inhibit moisture, mud, and/or other foreign debris from entering the shot holding body/chamber 1 and impacting the integrity of the pelletized powder or pelletized propellant.

When the loading mechanism is not assembled to the shot holding body/chamber 1, an additional end cap can be utilized on the opposite end of the shot holding body/chamber 1 to provide weather resistance of a loaded housing chamber for storage, thereby further inhibiting moisture, mud, and/or other foreign debris from entering the shot holding body/chamber 1 and impacting the integrity of the pelletized powder or pelletized propellant.

Figure 2:
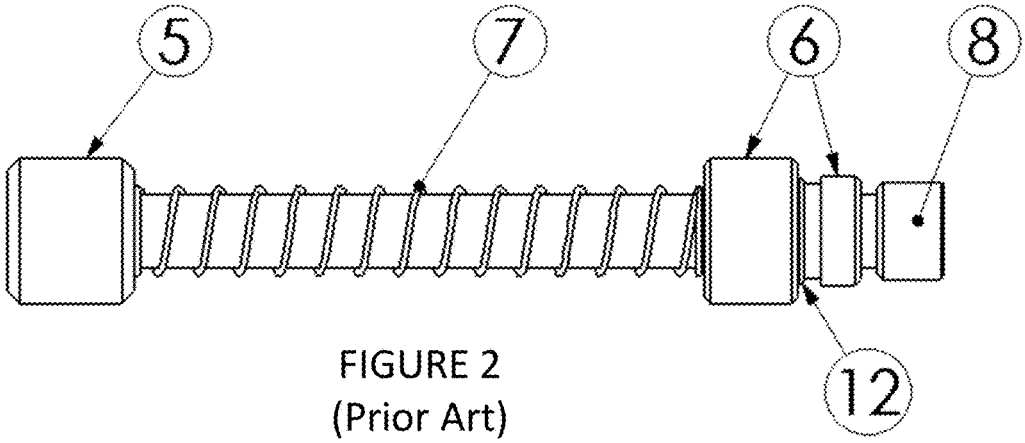
FIGURE 2 (Prior Art)
FIG. 2 is an illustration of the loading mechanism (actuator) of the conventional muzzle loading device of FIG. 1.

FIG. 2 illustrates the loading mechanism (actuator) of the conventional muzzle loading device of FIG. 1. As illustrated in FIG. 2, the loading mechanism includes a plunger 5, a spring 7, a nut 6, an O-ring 12, and a bullet seat 8.

The plunger 5 of FIG. 2 is a component that translates along the center axis of the shot holding body/chamber 1 to provide the force needed to move the shot out of the shot holding body/chamber 1 and into the muzzle of the muzzleloader firearm. The plunger 5 may include a head portion and a rod portion. This component may also include a feature to store a muzzle loader primer (or primer disc) for easy access.

The nut 6 of FIG. 2 is a component that is situated between bullet seat 8 and the end of plunger 5. The nut 6 is sized for the plunger 5 to slide freely through the inside diameter of the nut 6. The nut 6 is grooved on an outer diameter to receive an O-ring 12.

The nut 6 may have external threads or alternative non-permanent fastening feature on a reduced diameter region 6C, ahead of the O-ring groove 6B, to enable the nut 6 to screw (or fasten) to the shot holding body/chamber 1, and align the axis of the actuator with the axis of the body/chamber 1, as more specifically described below relative to FIG. 6.

The O-ring 12 seals the shot holding body/chamber 1 to the nut 6 once fully assembled to inhibit moisture, mud, and/or other foreign debris from entering the shot holding body/chamber 1 and impacting the integrity of the pelletized powder or pelletized propellant.

The outermost surface of shoulder 6A of nut 6 may include a feature (i.e.—knurl, hex, crosshatch) to provide additional grip to ensure nut 6 is screwed or fastened securely to the shot holding body/chamber 1.

It is noted that the nut 6 may be a quick release connection device that enables a secured connection to the shot holding body/chamber 1.

It is further noted that the nut 6 may be a removable connection device that enables a secured connection to the shot holding body/chamber 1.

It is also noted that nut 6 may provide a permanent connection that enables a secured connection to the shot holding body/chamber 1.

Spring 7 of FIG. 2 encircles the rod portion of the plunger 5 and is situated between the head portion of the plunger 5 and the nut 6.

Spring 7 functions to return the plunger 5 to a starting position after actuation, wherein the rod portion of the plunger 5 is outside the shot holding body/chamber 1 at the starting position.

In other words, the spring 7 functions to bias the plunger 5 away from the shot holding body/chamber 1 connected thereto.

The spring 7 also reduces the risk of an accidental actuation and provides a hard stop to limit the plunger 5 from travelling too far into the shot holding body/chamber 1, thereby preventing the bullet seat 8 from traveling beyond the end of a restraining mechanism (restraining mechanism or flexible finger guide 3 of FIG. 3) in the shot holding body/chamber 1.

The bullet seat 8 of FIG. 2 is located at the end of the rod portion of the plunger 5 to provide an interface between the plunger 5 and a bullet (projectile). The bullet seat 8 pushes on the bullet during actuation and forces the shot out of the shot holding body/chamber 1 and seats the bullet into the muzzle/barrel of the firearm.

Figure 3:
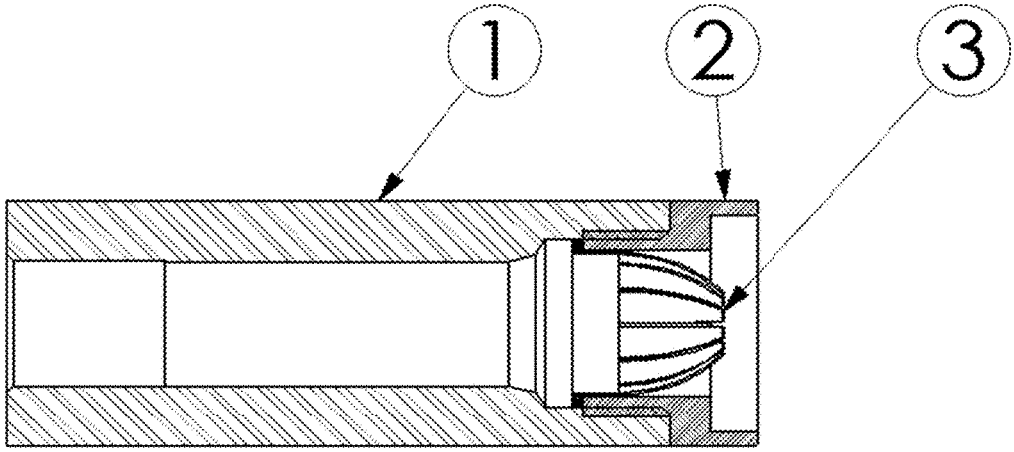
FIGURE 3 (Prior Art)
FIG. 3 is an illustration of the "shot" (pelletized propellant and projectile) enclosure (holding device) of the conventional muzzle loading device of FIG. 1.

FIG. 3 illustrates the shot holding device of the conventional muzzle loading device of FIG. 1. As illustrated in FIG. 3, the shot holding device includes a shot holding body/chamber 1, a restraining mechanism or flexible finger guide 3, and a barrel seat 2.

The shot holding body/chamber 1 of FIG. 3 is a cylindrical through-hole component that houses the shot (pelletized powder and bullet). The shot holding body/chamber 1 is assembled to the restraining mechanism or flexible finger guide 3 by the barrel seat 2.

The shot holding body/chamber 1 also allows clearance for the bullet seat 8 and plunger 5, during actuation.

When the shot holding body/chamber 1 is assembled to the restraining mechanism or flexible finger guide 3 and the barrel seat 2, the pelletized powder and bullet are restrained by the restraining mechanism or flexible finger guide 3 which eliminates the risk of dropping or "fumbling" pelletized powder and the bullet.

In other words, the restraining mechanism or flexible finger guide 3 substantially eliminates the risk of the pelletized powder and/or the bullet from falling out of the shot holding body/chamber 1.

The restraining force of the restraining mechanism or flexible finger guide 3 is approximately the gravitational force on the pelletized powder and bullet.

The restraining mechanism or flexible finger guide 3 of FIG. 3 provides axial restraint for the pelletized powder and bullet inside the shot holding body/chamber 1. The restraining mechanism or flexible finger guide 3 is a flexible component that is rigid enough to allow for standard handling and even slight shock loads in any orientation without allowing the pelletized powder or bullet to fall out of the shot holding body/chamber 1.

The restraining mechanism or flexible finger guide 3 also flexes (open state) to allow for dispersion of the pelletized powder and bullet from the shot holding body/chamber 1 to the muzzle/barrel of the firearm when the plunger 5 is actuated so that it travels through the shot holding body/chamber 1.

Once the pelletized powder and bullet are dispersed, and the plunger 5 springs back to the "starting" position, the restraining mechanism or flexible finger guide 3 returns to its original closed state and functionality, which is to restrain pelletized powder and bullet inside the shot holding body/chamber 1 prior to actuation.

The restraining mechanism or flexible finger guide 3 allows, when the end cap 4 is off and the conventional muzzle loading device is considered "ready to use", the pellets and the bullet to be still restrained, allowing the user to hold the conventional muzzle loading device in any orientation without the risk of the pelletized powder and the bullet falling out of the conventional muzzle loading device.

The barrel seat 2 of FIG. 3 is sized to fit over the end of or over the outer perimeter of a muzzle/barrel of a muzzleloader firearm. The barrel seat 2 also aligns with the conventional muzzle loading device for actuation.

The barrel seat 2 may house restraining mechanism or flexible finger guide 3.

If the barrel seat 2 does not house the restraining mechanism or flexible finger guide 3, the shot holding body/chamber 1 would include a groove or ringed ledge to seat the restraining mechanism or flexible finger guide 3.

The barrel seat 2 may be threaded onto the shot holding body/chamber 1.

It is also noted that the barrel seat 2 may be connected to the shot holding body/chamber 1 using a quick release connection device.

If the barrel seat 2 houses the restraining mechanism or flexible finger guide 3, the connection mechanism used to connect the barrel seat 2 to the shot holding body/chamber 1 could allow loading of the shot holding body/chamber 1 with a shot by removing the barrel seat 2.

The barrel seat 2 may be custom shaped to correspond to various outside diameters or outside geometries of the muzzle/barrel of a firearm to enable the barrel seat 2 to easily slip over the outer perimeter of the muzzle/barrel of the firearm and provide proper alignment for loading.

Figure 4:
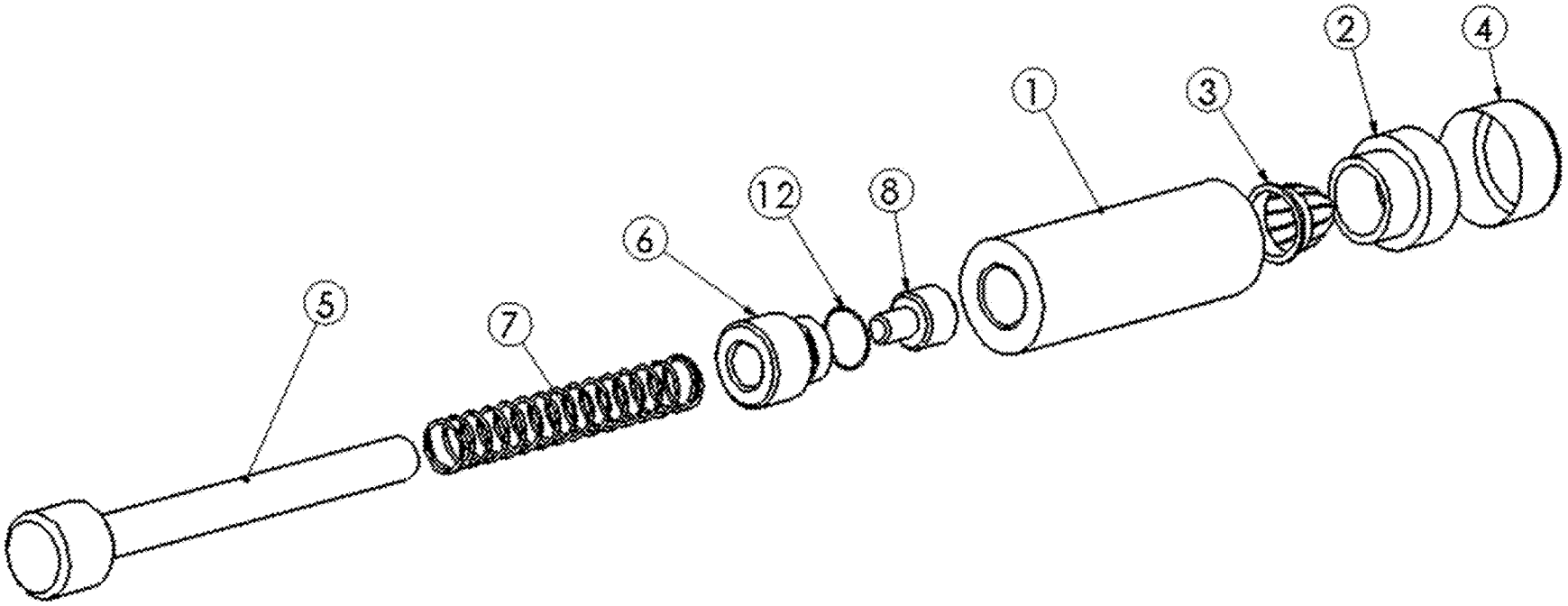
FIGURE 4 (Prior Art)
FIG. 4 is an exploded illustration of the conventional muzzle loading device of FIG. 1.

FIG. 4 illustrates an exploded view of the conventional muzzle loading device with an end cap 4. As illustrated in FIG. 4, the conventional muzzle loading device includes a plunger 5, a spring 7, a nut 6, an O-ring 12, a bullet seat 8, a shot holding body/chamber 1, a restraining mechanism or flexible finger guide 3, a barrel seat 2, and an end cap 4.

Figure 5:
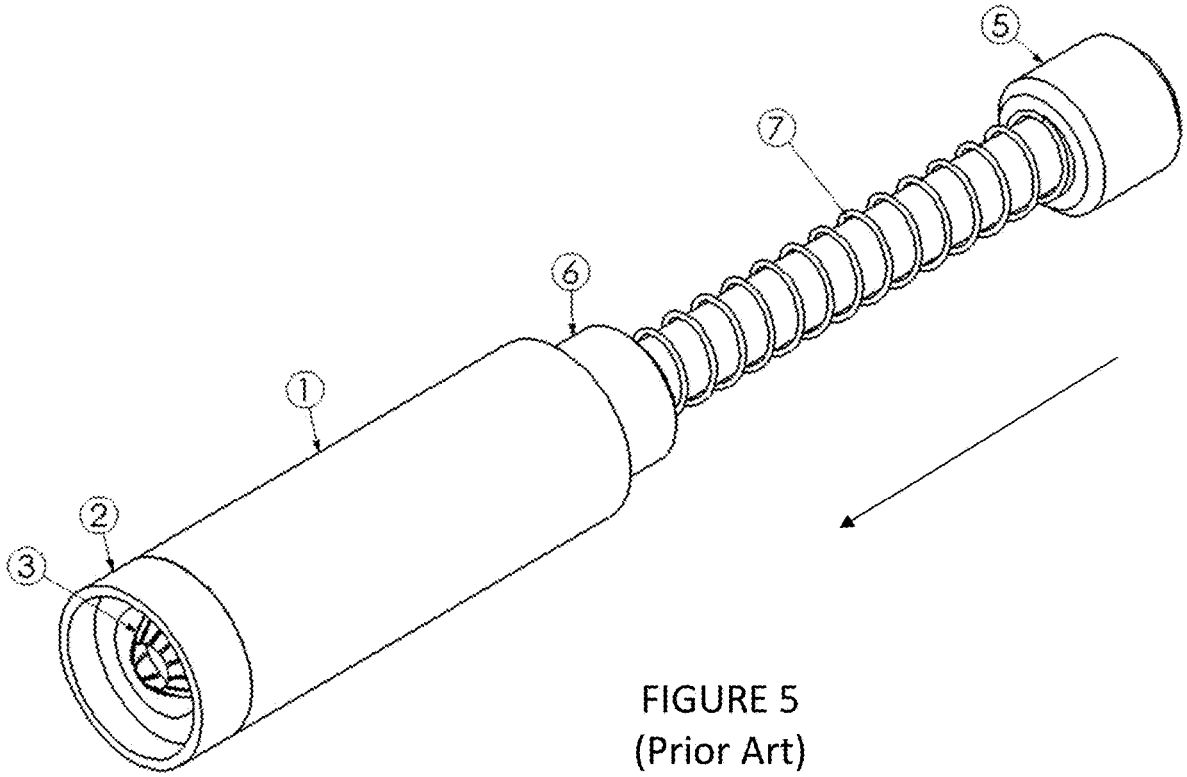
FIGURE 5 (Prior Art)
FIG. 5 is an illustration of the conventional muzzle loading device of FIG. 1 in a ready to load state.

FIG. 5 illustrates the conventional muzzle loading device in a "ready to use" state wherein actuation of the plunger 5, in the direction of the arrow, will dislodge the shot from the shot holding body/chamber 1, through the restraining mechanism or flexible finger guide 3, into a muzzle/barrel of a muzzle loading firearm.

Figure 6:
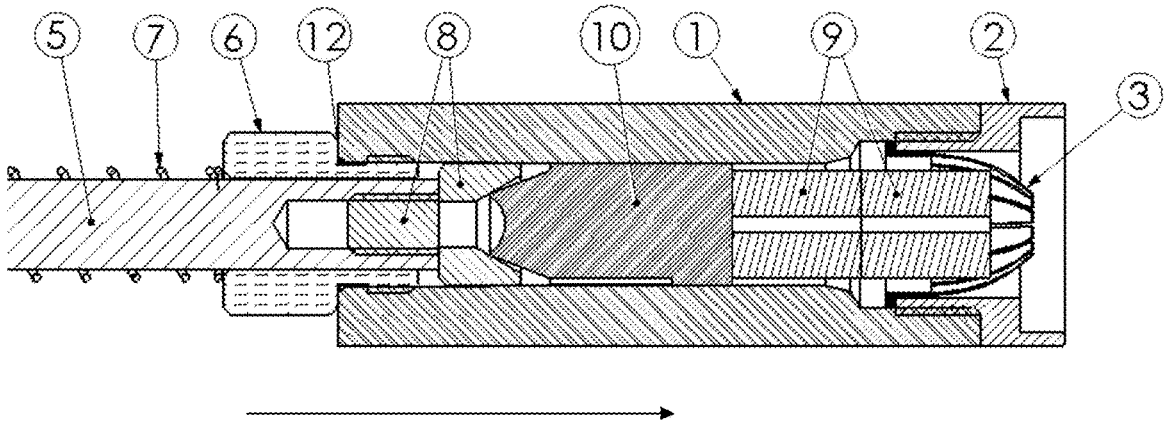
FIGURE 6 (Prior Art)
FIG. 6 is a cross-sectional illustration of the conventional muzzle loading device of FIG. 1 in a ready to load state with "shot" (pelletized propellant and projectile)

As illustrated in FIG. 6, the shot holding body/chamber 1 holds a bullet 10 and pelletized powder (pelletized propellant) 9, wherein the positioning of the bullet 10 and pelletized powder 9 in the shot holding body/chamber 1 is such that the pelletized powder 9 enter the muzzle/barrel of the muzzle loading firearm before the bullet 10 when loading (actuation of the plunger 5 in the direction of the arrow).

Moreover, as illustrated in FIG. 6, restraining mechanism or flexible finger guide 3 holds the bullet 10 and pelletized powder 9 in the shot holding body/chamber 1 until the plunger 5 is actuated in the direction of the arrow. The bullet seat 8 provides an interface between the plunger 5 and the bullet 10 and prevents damage to the surface of the bullet 10. FIG. 6 also illustrates the interaction between nut 6 and body/chamber 1.

More specifically, nut 6 may have external threads on the reduced diameter region 6C, to permit the nut 6 to be removably fastened or threaded to the shot holding body/chamber 1.

Although illustrated as mating threads on region 6C and the corresponding interior portion of body/chamber 1, it will be appreciated that another nonpermanent or releasable fastening feature (e.g., ball plunger, bayonet latch biased by the compressed O-ring 12) may be used to accomplish the releasable attachment of the nut 6 to body/chamber 1.

Nut 6 may also include a chamfer or similar feature on a lead edge to enable, along with the releasable attachment feature, the self-alignment of the nut with the body/chamber 1.

Figure 7:
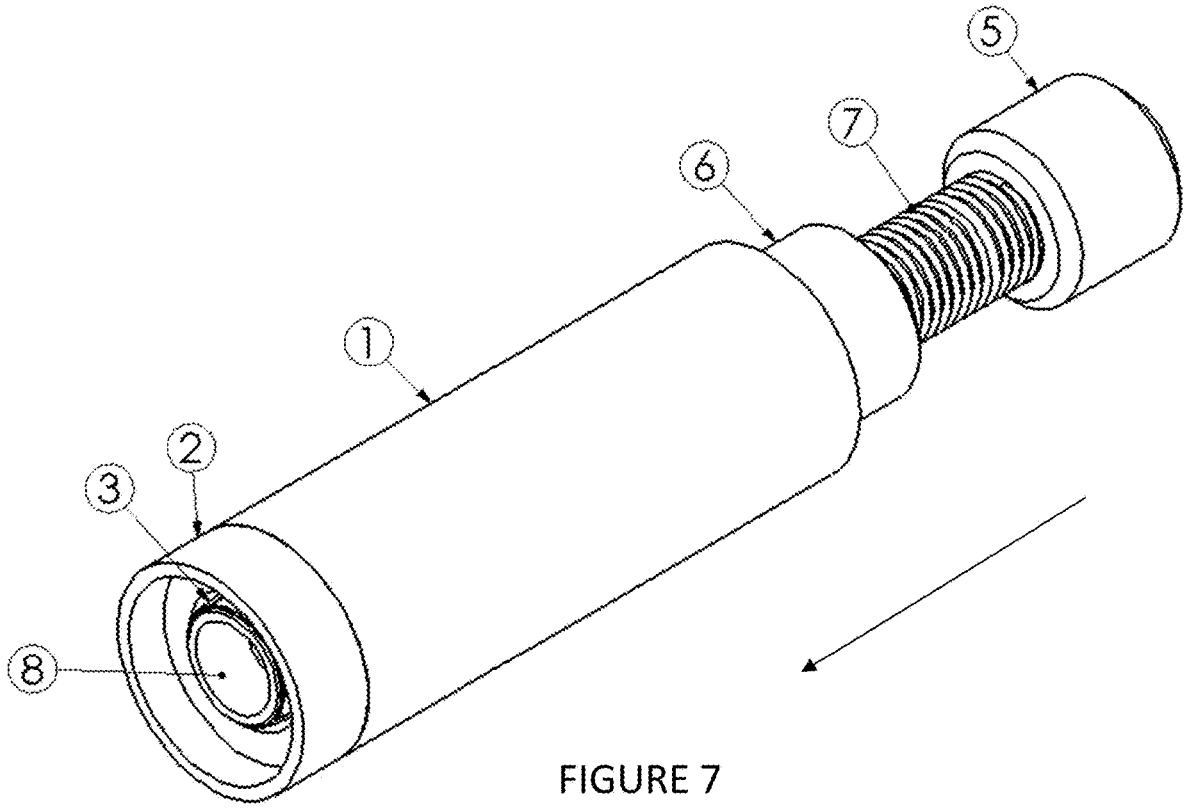
FIGURE 7 (Prior Art)
FIG. 7 is an illustration of the conventional muzzle loading device of FIG. 1 in a post actuated state or post loading state.

FIG. 7 illustrates the conventional muzzle loading device after actuation of plunger 5 in the direction of arrow.

Figure 8:
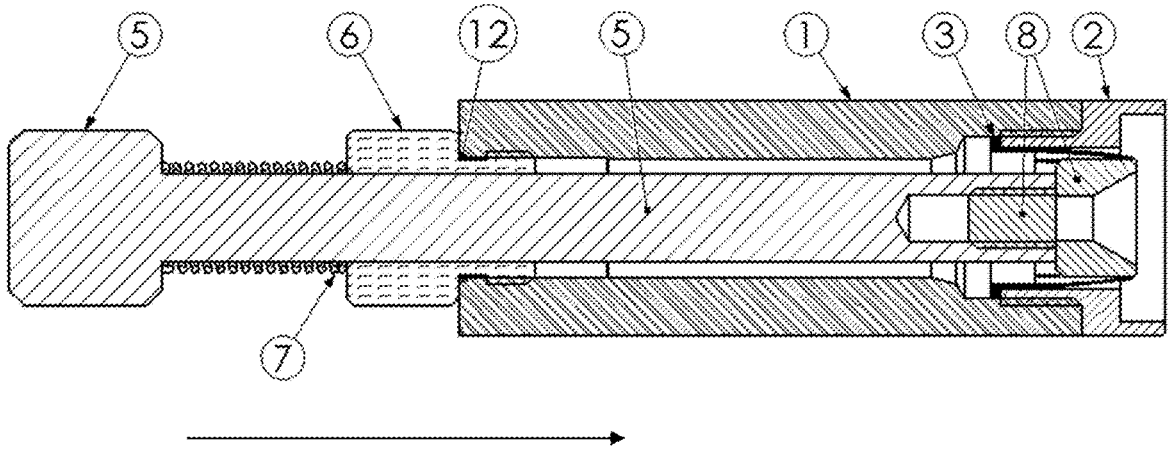
FIGURE 8 (Prior Art)
FIG. 8 is a cross-sectional illustration of the conventional muzzle loading device of FIG. 1 in a post actuated state or post loading state.

As illustrated in FIG. 8, the shot holding body/chamber 1 no longer holds a bullet 10 and pelletized powder 9 upon actuation of the plunger 5 in the direction of arrow.

FIG. 8 illustrates the restraining function of spring 7, preventing bullet seat 8 from going beyond the opened restraining mechanism or flexible finger guide 3.

Figure 9:
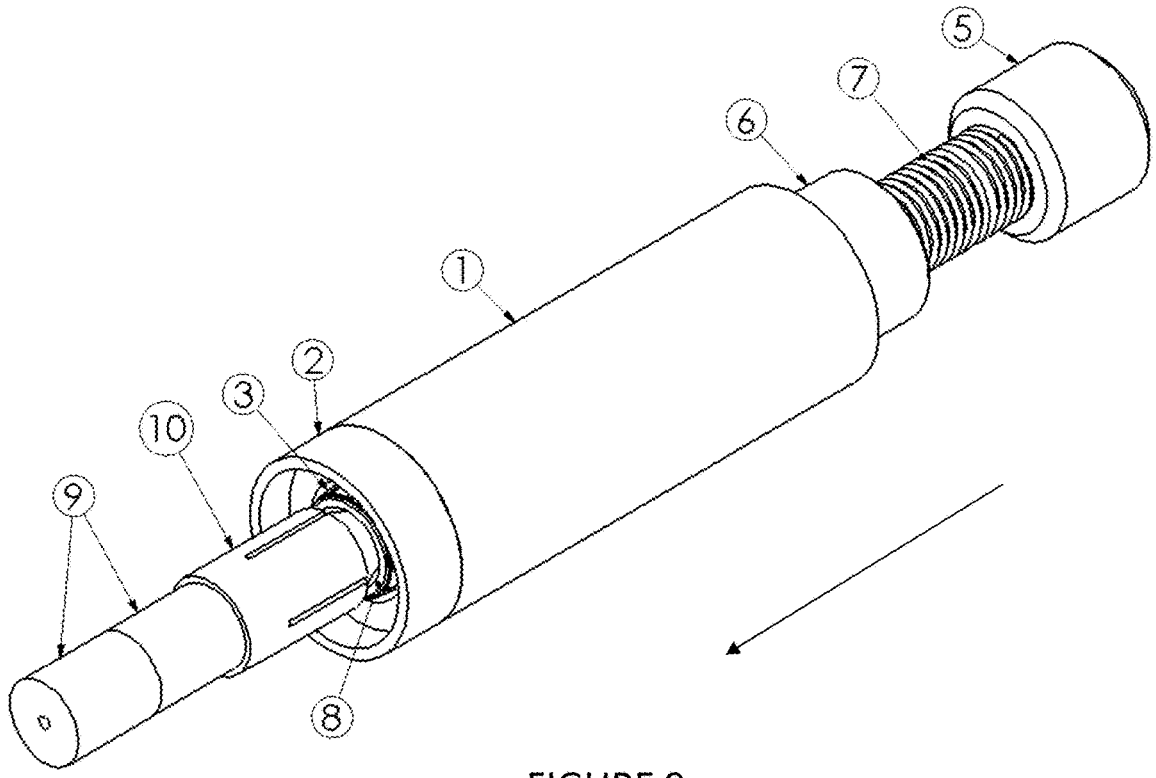
FIGURE 9 (Prior Art)
FIG. 9 is an illustration of the conventional muzzle loading device of FIG. 1 with "shot" (pelletized propellant and projectile) in a post actuated state or post loading state.

FIG. 9 illustrates the conventional muzzle loading device loading the muzzle/barrel of a muzzle loading firearm, with the bullet 10 and pelletized powder 9, after actuation of the plunger 5 in the direction of arrow.

Figure 10:
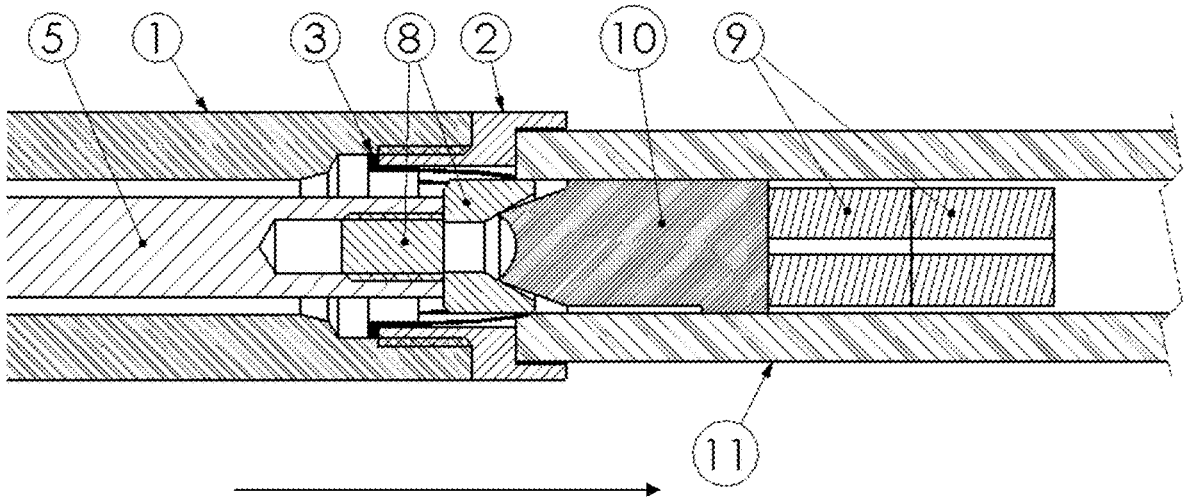
FIGURE 10 (Prior Art)
FIG. 10 is a cross-sectional illustration of the conventional muzzle loading device of FIG. 1 with "shot" (pelletized propellant and projectile) in a post actuated state or post loading state within the muzzleloader barrel.

As illustrated in FIG. 10, the shot holding body/chamber 1 no longer holds the bullet 10 and pelletized powder 9, wherein, upon actuation of the plunger 5 in the direction of arrow, the position of the bullet 10 and pelletized powder 9 are in the muzzle/barrel 11 of the muzzle loading firearm.

FIG. 10 illustrates the geometry of the barrel seat 2 corresponds to the outside diameter or outside geometry of the muzzle/barrel 11 of the muzzle loading firearm to enable the barrel seat 2 to easily slip over the outer perimeter of the muzzle/barrel 11 of the muzzle loading firearm and provide proper alignment for loading.

Figure 11:
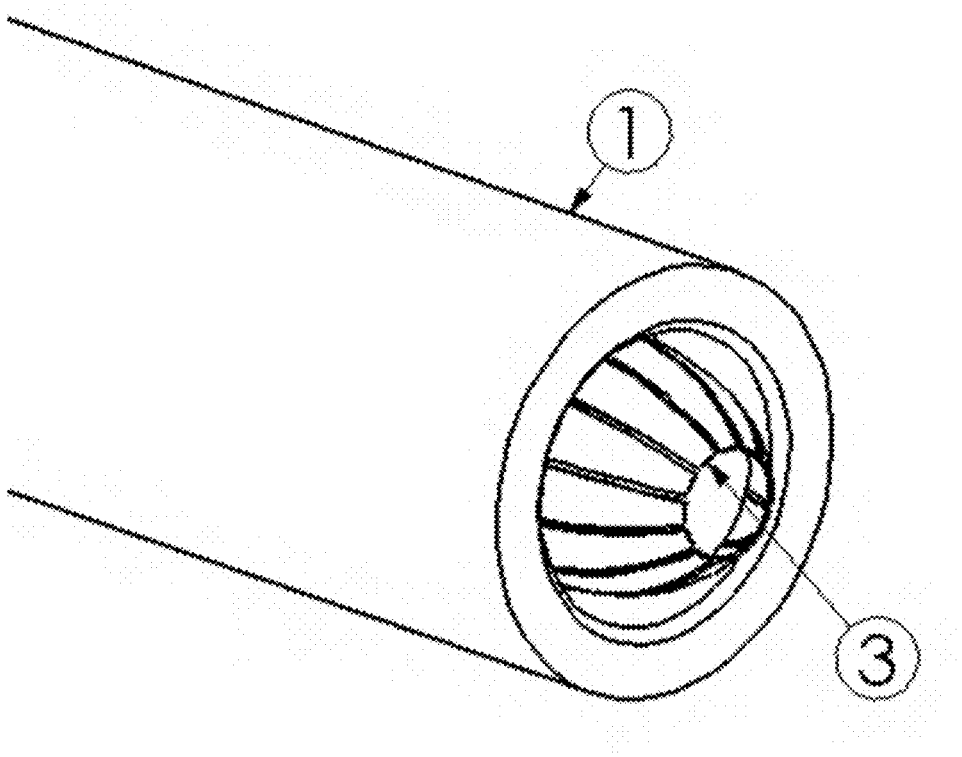
FIGURE 11 (Prior Art)
FIG. 11 is an illustration of "shot" (pelletized propellant and projectile) restraining mechanism for the conventional muzzle loading device of FIG. 1 in a closed state or ready to load state.

FIG. 11 illustrates the restraining mechanism or flexible finger guide 3 in a closed state or ready to load state.

As illustrated in FIG. 11, the restraining mechanism or flexible finger guide 3 restrains, when the end cap 4 is off, the pellets and the bullet, allowing the user to hold the conventional muzzle loading device in any orientation without the risk of the pelletized powder and the bullet falling out of the conventional muzzle loading device.

Figure 12:
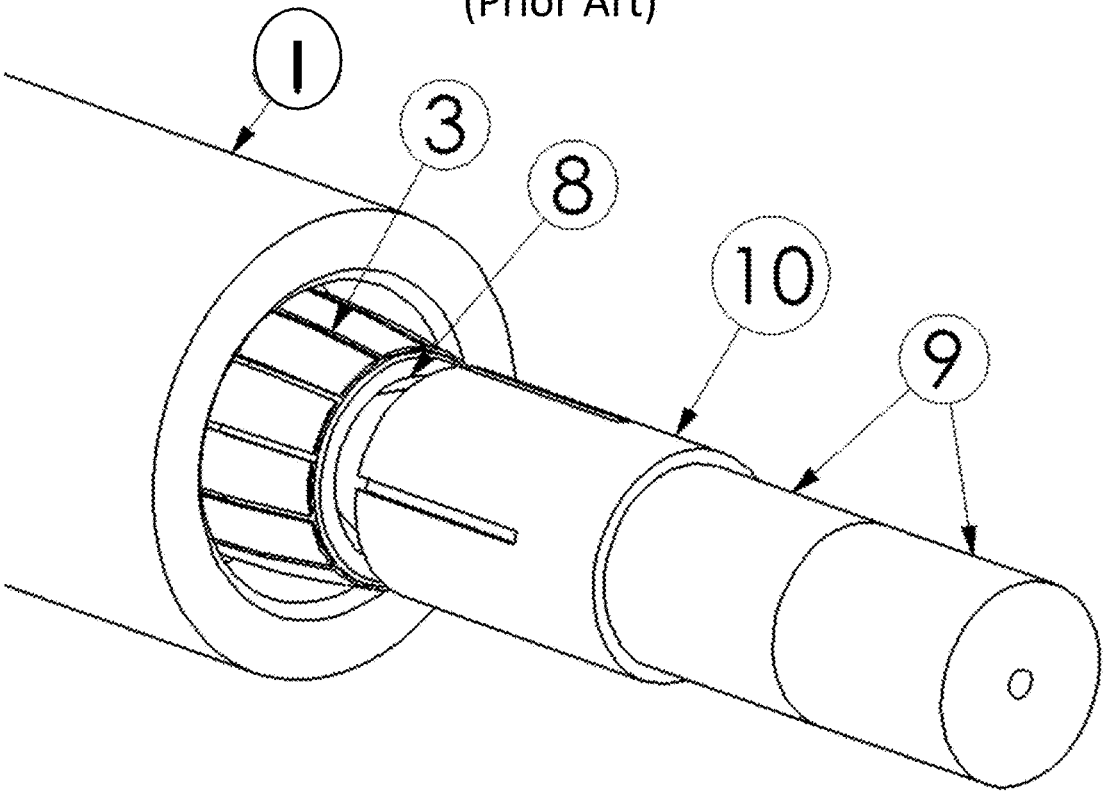
FIGURE 12 (Prior Art)
FIG. 12 is an illustration of "shot" (pelletized propellant and projectile) restraining mechanism for the conventional muzzle loading device of FIG. 1 in an open state or post actuated state.

FIG. 12 illustrates the restraining mechanism or flexible finger guide 3 in an open state or post actuated state.

As illustrated in FIG. 12, the restraining mechanism or flexible finger guide 3 provides enough flexibility to allow for dispersion of the pelletized powder 9 and bullet 10 from the shot holding body/chamber 1 to the muzzle/barrel of the firearm.

The conventional muzzle loading device, as described above, allows a hunter to carry a preloaded powder charge and bullet in a weather resistant chamber assembly.

When ready to load, a hunter does not have to remove caps and dump in pelletized powder, then places the bullet over the barrel, ensuring proper alignment, before forcing the bullet into the barrel with a bullet starter.

With the pelletized powder and bullet "preloaded" into the conventional muzzle loading device, when a hunter is ready to load the muzzleloader, the end cap is removed and the conventional muzzle loading device is simply placed over the end of the muzzleloader barrel. The hunter then applies a force on the spring-loaded actuator, and the powder charge and bullet are dispensed into the muzzleloader barrel in one action.

The hunter does not have to dump in the pelletized powder separately, nor utilize a bullet starter to ensure alignment and proper depth prior to using the muzzleloader's ramrod.

To load the conventional muzzle loading device, either the loading mechanism of the conventional muzzle loading device is disassembled from the shot holding device, as illustrated in FIGS. 2 and 3, or the barrel seat 2 is disconnected from the shot holding body/chamber 1. The pelletized powder 9 are loaded into the shot holding body/chamber 1, followed by the bullet 10, as illustrated in FIG. 6, or the bullet 10 is loaded into the shot holding body/chamber 1, followed by the pelletized powder 9, when the barrel seat 2 is disconnected from the shot holding body/chamber 1.

The shot holding device is now loaded and ready for either installation of end caps 4 on both ends for weather resistant storage, or "Ready to Load" by attaching the nut 6 to the shot holding body/chamber 1.

The hunter's next step, when ready to load, is to place the self-aligning conventional muzzle loading device over the barrel for actuation.

It is noted that when conventional muzzle loading device is in a "ready to use" state, the shot holding body/chamber 1 is sealed by end cap 4 at one end and the O-ring seal 12 on the nut 6 (at the other end) in an attempt to prevent moisture, mud, or other foreign debris from entering the shot holding body/chamber 1 and impacting the integrity of the pelletized powder 9.

An alternative "ready to use" state is as described above, without end cap 4, for elimination of the step to remove the end cap prior to load.

It is noted that shot holding body/chamber 1 can be customized based on the number of pelletized powder 9, the size of pelletized powder 9, and the caliber of the bullet 10.

It is noted that barrel seat 2 is designed to fit over the outer perimeter of a muzzleloader barrel 11 to allow for proper conventional muzzle loading device actuation and alignment.

As noted above, prior to actuation, the pelletized powder 9 and bullet 10 are restrained by the restraining mechanism or flexible finger guide 3 and the bullet seat 8, wherein is the bullet seat 8 constrained by the nut 6.

When the conventional muzzle loading device is properly aligned on the muzzle/barrel 11, the plunger 5 is compressed (by user force) to load the muzzleloader to a "ramrod ready" state.

Figure 13:
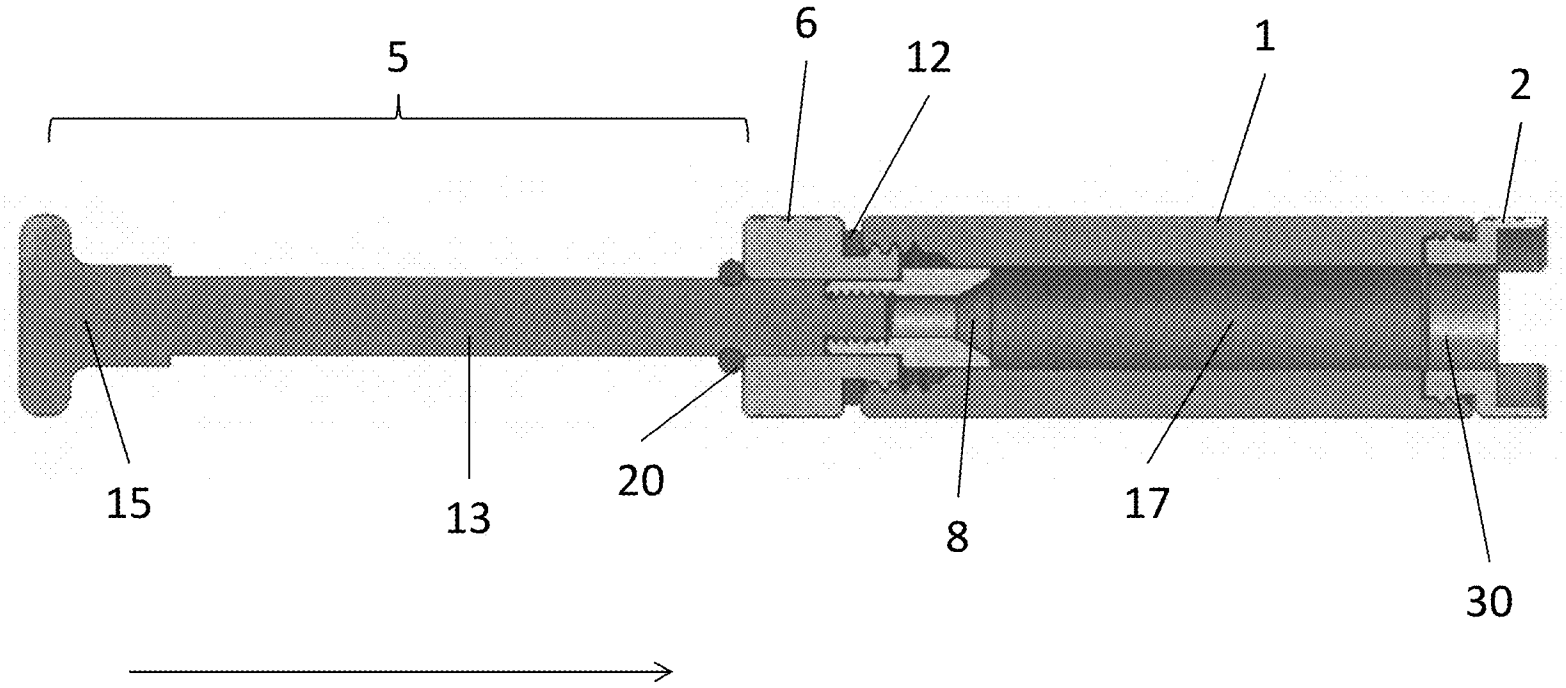
FIG. 13 is an illustration of a muzzle loading device for a non-pelletized propellant (powder)

As noted above, FIG. 13 illustrates a muzzle loading device for loading non-pelletized powder. As illustrated in FIG. 13, the muzzle loading device includes a shot holding body/chamber 1, which holds the non-pelletized propellant and projectile (17) prior to loading into a muzzle of a firearm, and an actuator or loading mechanism (plunger 5 and nut 6) for providing the actuation or force needed to load the shot (non-pelletized propellant and projectile (17)) into an end of a muzzle of a muzzleloader firearm.

The muzzle loading device may include an end cap (not shown), which slides over the end of the shot holding body/chamber 1, to inhibit moisture, mud, and/or other foreign debris from entering the shot holding body/chamber 1 and impacting the integrity of the non-pelletized powder or non-pelletized propellant.

When the loading mechanism is not assembled to the shot holding body/chamber 1, an additional end cap can be utilized on the opposite end of the shot holding body/chamber 1 to provide weather resistance of a loaded housing chamber for storage, thereby further inhibiting moisture, mud, and/or other foreign debris from entering the shot holding body/chamber 1 and impacting the integrity of the non-pelletized powder or non-pelletized propellant.

As illustrated in FIG. 13, the loading mechanism includes a plunger 5, a nut 6, an O-ring 12, and a bullet seat 8.

The plunger 5 of FIG. 13 is a component that translates along the center axis of the shot holding body/chamber 1 to provide the force needed to move the shot (non-pelletized propellant and projectile (17)) out of the shot holding body/chamber 1 and into the muzzle of the muzzleloader firearm. The plunger 5 includes a head portion 15 and a rod portion 13. This component may also include a feature to store a muzzle loader primer (or primer disc) for easy access.

Nut 6 of FIG. 13 is a component that is situated between bullet seat 8 and the end of plunger 5. Nut 6 is sized for plunger 5 to slide freely through the inside diameter of the nut 6. Nut 6 is grooved on an outer diameter to receive the O-ring 12.

The nut 6 may have external threads or alternative non-permanent fastening feature on a reduced diameter region, ahead of the O-ring groove, to enable the nut 6 to screw (or fasten) to the shot holding body/chamber 1 and align the axis of the actuator with the axis of the body/chamber 1.

The O-ring 12 seals the shot holding body/chamber 1 to the nut 6 once fully assembled to inhibit moisture, mud, and/or other foreign debris from entering the shot holding body/chamber 1 and impacting the integrity of the non-pelletized powder or non-pelletized propellant.

The outermost surface of shoulder of nut 6 may include a feature (i.e.—knurl, hex, crosshatch) to provide additional grip to ensure nut 6 is screwed or fastened securely to the shot holding body/chamber 1.

It is noted that the nut 6 may be a quick release connection device that enables a secured connection to the shot holding body/chamber 1.

It is further noted that the nut 6 may be a removable connection device that enables a secured connection to the shot holding body/chamber 1.

It is also noted that nut 6 may provide a permanent connection that enables a secured connection to the shot holding body/chamber 1.

An O-ring 20 of FIG. 13 encircles the rod portion 13 of the plunger 5 and is situated between the head portion 15 of the plunger 5 and the nut 6.

The O-ring 20 functions to provide a hard stop to limit the plunger 5 from travelling too far into the shot holding body/chamber 1, thereby preventing the bullet seat 8 from traveling beyond the end of a non-pelletized powder restraining mechanism 30 in the shot holding body/chamber 1.

The bullet seat 8 of FIG. 13 is located at one end of the rod portion 13 of the plunger 5 to provide an interface between the plunger 5 and the shot (non-pelletized propellant and projectile (17)). The bullet seat 8 pushes on the shot (non-pelletized propellant and projectile (17)) during actuation and forces the shot (non-pelletized propellant and projectile (17)) out of the shot holding body/chamber 1 and seats the projectile (bullet) into the muzzle/barrel of the firearm.

As illustrated in FIG. 13, the shot holding device includes the non-pelletized powder restraining mechanism 30 and a barrel seat 2.

The shot holding body/chamber 1 of FIG. 13 is a cylindrical through-hole component that houses the shot (non-pelletized propellant and projectile (17)). The shot holding body/chamber 1 is assembled to the non-pelletized powder restraining mechanism 30 by the barrel seat 2.

The shot holding body/chamber 1 also allows clearance for the bullet seat 8 and plunger 5, during actuation.

When the shot holding body/chamber 1 is assembled to the non-pelletized powder restraining mechanism 30 and the barrel seat 2, the shot (non-pelletized propellant and projectile (17)) is restrained by the non-pelletized powder restraining mechanism 30 which eliminates the risk of dropping or "fumbling" the shot (non-pelletized propellant and projectile (17)).

In other words, the non-pelletized powder restraining mechanism 30 substantially eliminates the risk of the shot (non-pelletized propellant and projectile (17)) from falling out of the shot holding body/chamber 1.

The non-pelletized powder restraining mechanism 30 of FIG. 13 provides axial restraint for the shot (non-pelletized propellant and projectile (17)) inside the shot holding body/chamber 1. The non-pelletized powder restraining mechanism 30 is a non-flexible component that is rigid to prevent the shot (non-pelletized propellant and projectile (17)) from falling out of the shot holding body/chamber 1.

Figure 14:
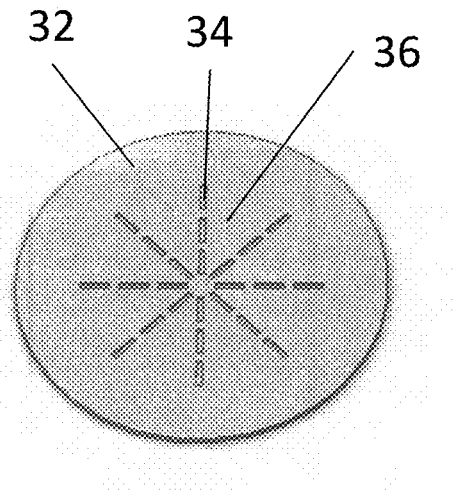
FIG. 14 is an illustration of the "shot" restraining mechanism of the muzzle loading device of FIG. 13 in a pre-actuated state or pre-loading state.

FIG. 14 illustrates a non-pelletized powder restraining mechanism constructed of a rigid disc 32 with radial perforated lines 34, forming tabs 36. As illustrated in FIG. 14, when in a pre-actuated state or pre-loaded state, as illustrated in FIG. 14, the tabs 36 are connected together by the radial perforated lines 34. This configuration (state) provides the axial restraint for the shot (non-pelletized propellant and projectile (17)) inside the shot holding body/chamber 1. Moreover, when in a pre-actuated state or pre-loaded state, as illustrated in FIG. 14, the non-pelletized powder restraining mechanism is rigid so as to prevent the shot (non-pelletized propellant and projectile) from falling out of the shot holding body/chamber.

Figure 15:
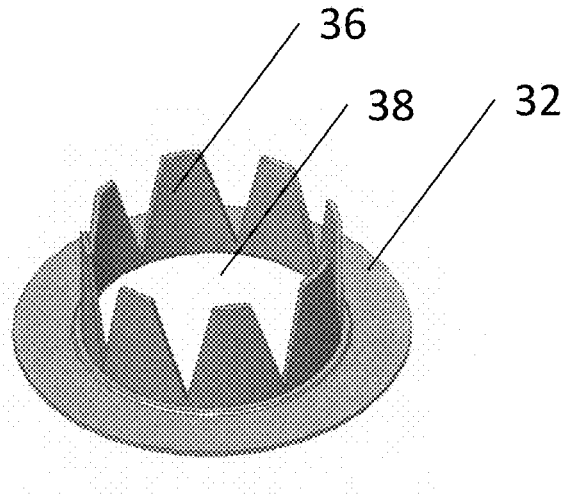
FIG. 15 is an illustration of the "shot" restraining mechanism of the muzzle loading device of FIG. 13 in a post actuated state or post loading state.

FIG. 15 illustrates a non-pelletized powder restraining mechanism in a post-actuated state or post-loaded state. As illustrated in FIG. 15, the tabs 36 project outwardly from the rigid disc 32 to form an opening 38 in the rigid disc 32. The tabs 36 are caused to project outwardly from the rigid disc 32 in response to the plunger providing the force needed to move the shot (non-pelletized propellant and projectile) out of the shot holding body/chamber and into the muzzle of the muzzleloader firearm. This configuration (state) provides the opening 38 needed to transfer the shot (non-pelletized propellant and projectile) out of the shot holding body/chamber and into the muzzle of the muzzleloader firearm. Moreover, when in the post-actuated state or post-loaded state, as illustrated in FIG. 15, the non-pelletized powder restraining mechanism is spent and no longer usable, thus, the non-pelletized powder restraining mechanism needs to be replaced to use the muzzle loading device again.

Once the shot (non-pelletized propellant and projectile) is dispersed, and the plunger 5 remains in a post-loaded position; i.e., the head portion 15 of the plunger 5 of FIG. 13 is located next to the nut 6 of FIG. 13. This allows the muzzle loading device to be stored in a compact configuration—the plunger residing within the shot holding body/chamber.

The non-pelletized powder restraining mechanism allows, when the optional end cap is off and the muzzle loading device is considered "ready to use", the shot (non-pelletized propellant and projectile) to be still restrained, allowing the user to hold the muzzle loading device in any orientation without the risk of the shot (non-pelletized propellant and projectile) falling out of the muzzle loading device.

The barrel seat 2 of FIG. 13 may be sized to fit over the end of or over the outer perimeter of a muzzle/barrel of a muzzleloader firearm. The barrel seat 2 also aligns the muzzle loading device for actuation.

As illustrated in FIG. 13, the barrel seat 2 may house the non-pelletized powder restraining mechanism 30.

If barrel seat 2 does not house the non-pelletized powder restraining mechanism 30, the shot holding body/chamber 1 would include a groove or ringed ledge to seat the non-pelletized powder restraining mechanism 30.

The barrel seat 2 may be threaded onto the shot holding body/chamber 1.

It is also noted that the barrel seat 2 may be connected to the shot holding body/chamber 1 using a quick release connection device.

If the barrel seat 2 houses the non-pelletized powder restraining mechanism 30, the connection mechanism used to connect the barrel seat 2 to the shot holding body/chamber 1 could allow loading of the shot holding body/chamber 1 with a shot by removing the barrel seat 2.

The barrel seat 2 may be custom shaped to correspond to various outside diameters or outside geometries of the muzzle/barrel of a firearm to enable the barrel seat 2 to easily slip over the outer perimeter of the muzzle/barrel of the firearm and provide proper alignment for loading.

Figure 16:
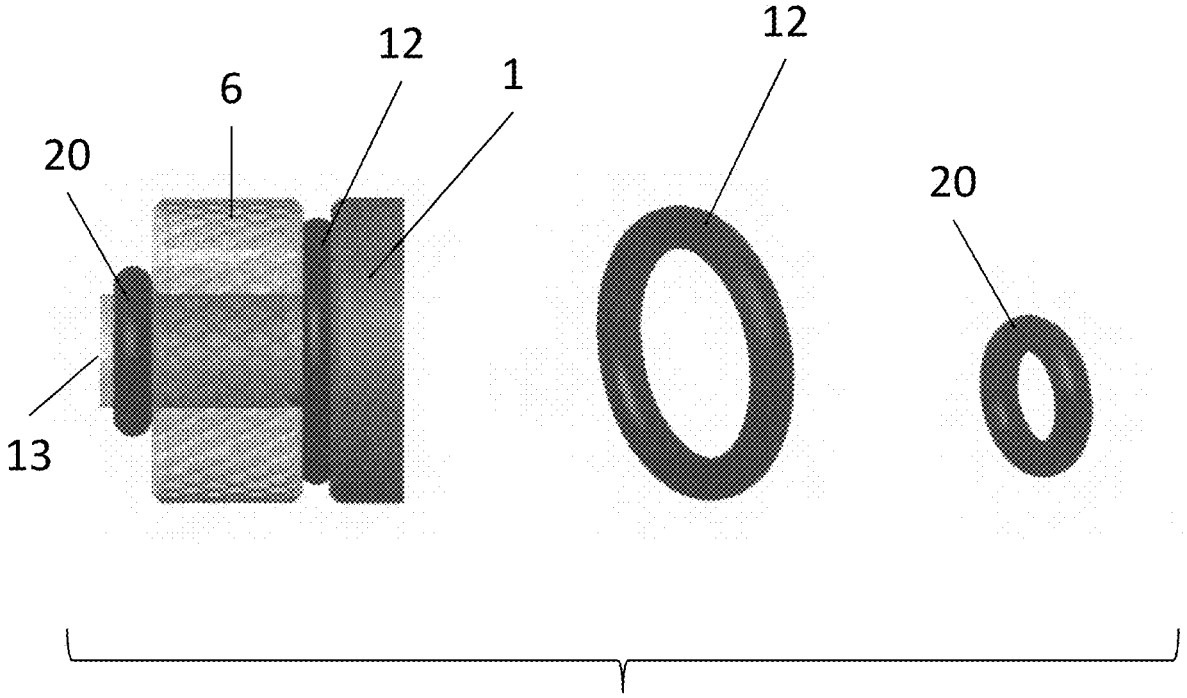
FIG. 16 is an illustration of the connection configuration between a plunger of the muzzle loading device of FIG. 13 and the "shot" (non-pelletized propellant and projectile) enclosure (holding device) of the muzzle loading device of FIG. 13.

FIG. 16 illustrates the connection configuration between the plunger 5 and the shot holding body/chamber 1. As illustrated in FIG. 16, a nut 6 is attached to one end of the shot holding body/chamber 1 with an O-ring 12 located at the interface between the nut 6 and the end of the shot holding body/chamber 1. As noted above, the O-ring 12 encircles the nut 6 and seals the shot holding body/chamber 1 to the nut 6 once fully assembled to inhibit moisture, mud, and/or other foreign debris from entering the shot holding body/chamber 1 and impacting the integrity of the non-pelletized powder or non-pelletized propellant.

As further illustrated by FIG. 16, an O-ring 20 encircles the rod portion 13 of the plunger 5 and is situated between a head portion 15 of the plunger 5 and the nut 6.

The O-ring 20 functions to provide a hard stop to limit the plunger 5 from travelling too far into the shot holding body/chamber 1, thereby preventing the bullet seat from traveling beyond the end of the non-pelletized powder restraining mechanism 30 in the shot holding body/chamber 1.

Moreover, the use of the O-ring 20, as opposed to the spring in the conventional muzzle loading device, enables the muzzle loading device to be stored in a compact configuration without having to remove the plunger from the shot holding body/chamber because the spring in the conventional muzzle loading device keeps the plunger in a ready state; i.e., the head portion of the plunger is farthest from the nut on the end of the shot holding body/chamber, thereby maximizing the length of the muzzle loading device.

As described above, the plunger dislodges the shot (non-pelletized propellant and projectile) from the shot holding body/chamber, through the non-pelletized powder restraining mechanism, into a muzzle/barrel of a muzzle loading firearm.

As illustrated in FIG. 13, the shot holding body/chamber 1 holds a shot (non-pelletized propellant and projectile (17)), wherein the positioning of a bullet (projectile) and non-pelletized powder (non-pelletized propellant) in the shot holding body/chamber 1 is such that the non-pelletized powder (non-pelletized propellant) enter the muzzle/barrel of the muzzle loading firearm before the bullet (projectile) when loading.

Moreover, as illustrated in FIG. 13, non-pelletized powder restraining mechanism 30 holds the shot (non-pelletized propellant and projectile (17)) in the shot holding body/chamber 1 until plunger 5 is actuated in the direction of the arrow. The bullet seat 8 provides an interface between the plunger 5 and the shot (non-pelletized propellant and projectile (17)) and prevents damage to the surface of the bullet (projectile).

As illustrated in FIG. 13, nut 6 may have external threads on a reduced diameter region, to permit the nut 6 to be removably fastened or threaded to the shot holding body/chamber 1.

Although illustrated as mating threads and the corresponding interior portion of shot holding body/chamber 1, it will be appreciated that another nonpermanent or releasable fastening feature (e.g., ball plunger, bayonet latch biased by the compressed O-ring 12) may be used to accomplish the releasable attachment of the nut 6 to shot holding body/chamber 1.

Nut 6 may also include a chamber or similar feature on a lead edge to enable, along with the releasable attachment feature, the self-alignment of the nut with the shot holding body/chamber 1.

The muzzle loading device, as described above, allows a hunter to carry a preloaded non-pelletized powder charge (non-pelletized propellant) and bullet (projectile) in a weather resistant chamber assembly.

When ready to load, a hunter does not have to remove caps and dump in non-pelletized powder (non-pelletized propellant), then place the bullet (projectile) over the barrel, ensuring proper alignment, before forcing the bullet (projectile) into the barrel with a bullet starter.

With the non-pelletized powder (non-pelletized propellant) and bullet (projectile) "preloaded" into the muzzle loading device, when a hunter is ready to load the muzzleloader, the muzzle loading device is simply placed over the end of the muzzleloader barrel. The hunter then applies a force on the actuator, and the non-pelletized powder charge (non-pelletized propellant) and bullet (projectile) is dispensed into the muzzleloader barrel in one action.

The hunter does not have to dump the non-pelletized powder (non-pelletized propellant) in separately, nor utilize a bullet starter to ensure alignment and proper depth prior to using the muzzleloader's ramrod.

To load the muzzle loading device, either the actuator (plunger 5 and nut 6) of the muzzle loading device is disassembled from the shot holding body/chamber 1, or the barrel seat 2 is disconnected from the shot holding body/chamber 1. The non-pelletized powder (non-pelletized propellant) is loaded into the shot holding body/chamber 1, followed by the bullet (projectile), or the bullet (projectile) is loaded into the shot holding body/chamber 1, followed by the non-pelletized powder (non-pelletized propellant), when the barrel seat 2 is disconnected from the shot holding body/chamber 1.

The shot holding device is now loaded and ready for either installation of end caps on both ends for weather resistant storage, or "Ready to Load" by attaching the nut 6 and plunger 5 to the shot holding body/chamber 1.

The hunter's next step, when ready to load, is to place the self-aligning muzzle loading device over the barrel for actuation.

It is noted that when muzzle loading device is in a "ready to use" state, the shot holding body/chamber 1 may be sealed by an end cap at one end and the O-ring seal 12 on the nut 6 (at the other end) in an attempt to prevent moisture, mud, or other foreign debris from entering the shot holding body/chamber 1 and impacting the integrity of the non-pelletized powder (non-pelletized propellant).

An alternative "ready to use" state is, as described above, without an end cap, for elimination of the step to remove the end cap prior to load.

It is noted that shot holding body/chamber 1 can be customized based on the amount of the non-pelletized powder (non-pelletized propellant) and the caliber of the bullet (projectile).

It is noted that the barrel seat 2 is designed to fit over the outer perimeter of a muzzleloader barrel to allow for proper muzzle loading device actuation and alignment.

As noted above, prior to actuation, the shot (non-pelletized propellant and projectile) is restrained by the non-pelletized powder restraining mechanism and the bullet seat, wherein is the bullet seat constrained by the nut.

When the muzzle loading device is properly aligned on the muzzle/barrel, the plunger is compressed (by user force) to load the muzzleloader to a "ramrod ready" state.

A device for loading an object into a muzzle comprises a shot holding member having a first end configured to receive an object to be loaded into the muzzle and a second end; the shot holding member including a hollow shot holding chamber; and an actuator located at the first end of the shot holding member; the actuator including a plunger having a head portion, a connector configured to connect the actuator to the first end of the shot holding member, a first O-ring configured to encircle the connector and located between the connector and the first end of the shot holding member, and a second O-ring configured to encircle the plunger and located between a head portion of the plunger and the connector.

The plunger may traverse a hollow portion of the hollow shot holding chamber and the second O-ring may prevent the plunger from travelling too far into the shot holding member.

The actuator may include a bullet seat.

The device may further comprise a reusable flexible restraining mechanism located at the second end of the shot holding member.

The actuator may include a bullet seat, the plunger traverses a hollow portion of the hollow shot holding chamber, and the second O-ring prevents the plunger from the bullet seat from traveling beyond an end of the reusable flexible restraining mechanism.

The device may further comprise a non-reusable flexible restraining mechanism located at the second end of the shot holding member.

The actuator may include a bullet seat, the plunger traverses a hollow portion of the hollow shot holding chamber, and the second O-ring prevents the plunger from the bullet seat from traveling beyond an end of the non-reusable flexible restraining mechanism.

The second end of the shot holding member may include an end portion shaped to correspond to an outside geometry of a muzzle.

The end portion may be removable from the shot holding member.

The actuator may be removable from the shot holding member

The actuator may be temporarily fastened to and self-aligning to the shot holding member.

The actuator may be permanently fastened to and self-aligned to the shot holding member.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. A device for loading an object into a muzzle comprising:

a shot holding member having a first end configured to receive an object to be loaded into the muzzle and a second end having a non-pelletized powder restraining mechanism;

said shot holding member including a hollow shot holding chamber; and an actuator being connected to said first end of said shot holding member;

said actuator including a bullet seat, a plunger having a head portion, a connector having a first end and a second end, said first end of said connector being configured to fixedly attach said actuator to said first end of said shot holding member, a first O-ring configured to encircle said connector and located between said connector and said first end of said shot holding member, and a second O-ring configured to encircle said plunger and located between a head portion of said plunger and said second end of said connector;

said second O-ring being configured to be in contact with both said second end of said connector and said head portion of said plunger when said plunger has travelled to said second end of said shot holding member;

said second O-ring being configured to prevent said bullet seat from traveling beyond an end of said non-pelletized powder restraining mechanism.

2. The device for loading an object into a muzzle, as claimed in claim 1, wherein said plunger traverses a hollow portion of said hollow shot holding chamber and said second O-ring prevents said plunger from travelling too far into said shot holding member when said second O-ring is in contact with both said second end of said connector and said head portion of said plunger.

3. The device for loading an object into a muzzle, as claimed in claim 1, wherein said actuator includes a bullet seat.

4. The device for loading an object into a muzzle, as claimed in claim 1, further comprising:

a reusable flexible restraining mechanism located at said second end of said shot holding member.

5. The device for loading an object into a muzzle, as claimed in claim 4, wherein said actuator includes a bullet seat, said plunger traverses a hollow portion of said hollow shot holding chamber, and said second O-ring prevents said plunger from said bullet seat from traveling beyond an end of the reusable flexible restraining mechanism when said second O-ring is in contact with both said second end of said connector and said head portion of said plunger.

6. The device for loading an object into a muzzle, as claimed in claim 1, further comprising:

a non-reusable flexible restraining mechanism located at said second end of said shot holding member.

7. The device for loading an object into a muzzle, as claimed in claim 6, wherein said actuator includes a bullet seat, said plunger traverses a hollow portion of said hollow shot holding chamber, and said second O-ring prevents said plunger from said bullet seat from traveling beyond an end of the non-reusable flexible restraining mechanism when said second O-ring is in contact with both said second end of said connector and said head portion of said plunger.

8. The device for loading an object into a muzzle, as claimed in claim 1, wherein said second end of said shot holding member includes an end portion shaped to correspond to an outside geometry of a muzzle.

9. The device for loading an object into a muzzle, as claimed in claim 8, wherein said end portion is removable from said shot holding member.

10. The device for loading an object into a muzzle, as claimed in claim 1, wherein said actuator is removable from said shot holding member.

11. The device for loading an object into a muzzle, as claimed in claim 1, wherein said actuator is temporarily fastened to and self-aligning to said shot holding member.

12. The device for loading an object into a muzzle, as claimed in claim 1, wherein said actuator is permanently fastened to and self-aligned to said shot holding member.

13. A device for loading an object into a muzzle comprising:

a shot holding member having a first end configured to receive an object to be loaded into the muzzle and a second end;

said shot holding member including a hollow shot holding chamber and a flexible restraining mechanism located at said second end of said shot holding member;

said second end of said shot holding member including an end portion shaped to correspond to an outside geometry of a muzzle; and an actuator being connected to said first end of said shot holding member;

said actuator including a bullet seat, a plunger having a head portion, a connector having a first end and a second end, said first end of said connector being configured to fixedly attach said actuator to said first end of said shot holding member, a first O-ring configured to encircle said connector and located between said connector and said first end of said shot holding member, and a second O-ring configured to encircle said plunger and located between a head portion of said plunger and said second end of said connector;

said second O-ring being configured to be in contact with both said second end of said connector and said head portion of said plunger when said plunger has travelled to said second end of said shot holding member;

said second O-ring being configured to prevent said bullet seat from traveling beyond an end of said flexible restraining mechanism.

14. The device for loading an object into a muzzle, as claimed in claim 13, wherein said end portion is removable from said shot holding member.

15. The device for loading an object into a muzzle, as claimed in claim 13, wherein said actuator is removable from said shot holding member.

16. The device for loading an object into a muzzle, as claimed in claim 13, wherein said actuator is temporarily fastened to and self-aligning to said shot holding member.

17. The device for loading an object into a muzzle, as claimed in claim 13, wherein said actuator is permanently fastened to and self-aligned to said shot holding member.

* * * * *